US009979069B2

(12) United States Patent
Faraone et al.

(10) Patent No.: US 9,979,069 B2
(45) Date of Patent: May 22, 2018

(54) WIRELESS BROADBAND/LAND MOBILE RADIO ANTENNA SYSTEM

(71) Applicant: MOTOROLA SOLUTIONS, INC., Schaumburg, IL (US)

(72) Inventors: Antonio Faraone, Fort Lauderdale, FL (US); Giorgi G. Bit-Babik, Plantation, FL (US)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 67 days.

(21) Appl. No.: 15/144,140

(22) Filed: May 2, 2016

(65) Prior Publication Data

US 2017/0317397 A1 Nov. 2, 2017

(51) Int. Cl.

| | |
|---|---|
| ***H01Q 21/00*** | (2006.01) |
| ***H01P 5/22*** | (2006.01) |
| ***H01Q 1/24*** | (2006.01) |
| ***H01Q 1/52*** | (2006.01) |

(52) U.S. Cl.
CPC ..... *H01P 5/22* (2013.01); *H01Q 1/241* (2013.01); *H01Q 1/523* (2013.01)

(58) Field of Classification Search
None
See application file for complete search history.

(56) References Cited

U.S. PATENT DOCUMENTS 5,038,151 A * 8/1991 Kaminski ..... H01Q 21/28 343/727
5,189,434 A 2/1993 Bell
5,264,862 A 11/1993 Kumpfbeck
5,648,787 A 7/1997 Ogot et al.
5,818,385 A * 10/1998 Bartholomew ..... H01Q 1/246 342/372
5,875,391 A 2/1999 Riley et al.
5,923,304 A 7/1999 Edwards
5,926,304 A * 7/1999 Tajima ..... H04B 10/2912 359/337.12

(Continued)

OTHER PUBLICATIONS

Snow et al, "Multi-antenna Near Field Cancellation Duplexing for Concurrent Transmit and Receive," IEEE MIT Int. Microw. Symp., Jun. 2011, pp. 1-4.

(Continued)

*Primary Examiner* — Trinh Dinh
(74) *Attorney, Agent, or Firm* — Michael Best & Friedrich LLP

(57) ABSTRACT

An antenna system. The antenna system includes a central antenna, and a plurality of peripheral antennas positioned symmetrically around the central antenna. A first coupler provides a first radio connection and a second radio connection. A first 180 degree hybrid coupler is coupled to a first two diametrically opposed antennas of the plurality of peripheral antennas. A second 180 degree hybrid coupler is coupled to a second two diametrically opposed antennas of the plurality of peripheral antennas. A third 180 degree hybrid coupler coupled to the first and second 180 degree hybrid couplers, and having a third radio connection and a fourth radio connection. The first, second, third, and fourth radio connections are decoupled from each other, and the first, second, and third system radio connections are also decoupled from the central antenna.

18 Claims, 20 Drawing Sheets

(56) References Cited

U.S. PATENT DOCUMENTS

| | | | | |
|---|---|---|---|---|
| 5,966,102 | A | 10/1999 | Runyon | |
| 6,064,861 | A | 5/2000 | Riley et al. | |
| 6,067,053 | A | 5/2000 | Runyon et al. | |
| 6,141,539 | A | 10/2000 | Marino | |
| 6,188,373 | B1 | 2/2001 | Martek | |
| 6,208,135 | B1 | 3/2001 | Shattil | |
| 6,211,846 | B1 | 4/2001 | Gouin | |
| 6,329,954 | B1 | 12/2001 | Fuchs et al. | |
| 6,335,706 | B1 | 1/2002 | Elliot | |
| 6,348,791 | B2 | 2/2002 | Shattil | |
| 6,492,959 | B1 | 12/2002 | Heatherwick et al. | |
| 6,509,883 | B1 | 1/2003 | Foti et al. | |
| 6,744,412 | B1 | 6/2004 | Lopez | |
| 6,806,838 | B2 | 10/2004 | Petros et al. | |
| 6,826,393 | B1 | 11/2004 | Komurasaki et al. | |
| 6,920,315 | B1 | 7/2005 | Wilcox et al. | |
| 7,138,959 | B2 | 11/2006 | Gaudette et al. | |
| 7,417,597 | B1 | 8/2008 | Lopez | |
| 7,633,998 | B2 | 12/2009 | Dockemeyer et al. | |
| 8,749,441 | B2 * | 6/2014 | Fenn | H01Q 1/525 343/793 |
| 9,148,890 | B1 | 9/2015 | Choi et al. | |
| 9,161,386 | B1 | 10/2015 | Beghini et al. | |
| 2003/0193446 | A1 * | 10/2003 | Chen | H01Q 1/246 343/893 |
| 2004/0150580 | A1 | 8/2004 | Gaudette et al. | |
| 2006/0133465 | A1 | 6/2006 | Dockemeyer, Jr. et al. | |
| 2007/0060058 | A1 | 3/2007 | Shattil | |
| 2009/0161655 | A1 * | 6/2009 | Uppala | H04J 3/0697 370/350 |
| 2011/0032159 | A1 * | 2/2011 | Wu | H01Q 21/08 343/702 |
| 2013/0050012 | A1 * | 2/2013 | Jungmaier | G01S 7/034 342/118 |
| 2013/0106667 | A1 * | 5/2013 | Fenn | H01Q 1/525 343/793 |

OTHER PUBLICATIONS

Andersen et al., "Decoupling and descattering networks for antennas," IEEE AP-T, Nov. 1976, pp. 841-846.

Wallace et al., "Termination-Dependent Diversity Performance of Coupled Antennas: Network Theory Analysis," IEEE AP-T, Jan. 2004, pp. 98-105.

* cited by examiner

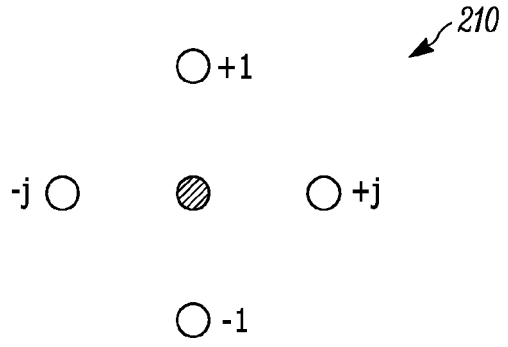
FIG. 3A
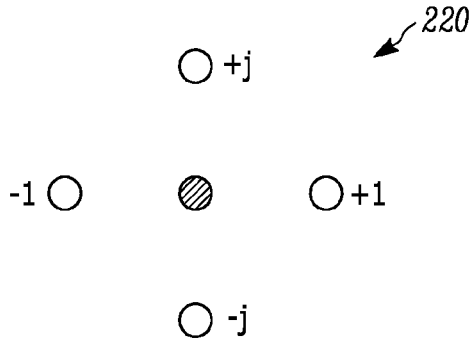
FIG. 3B
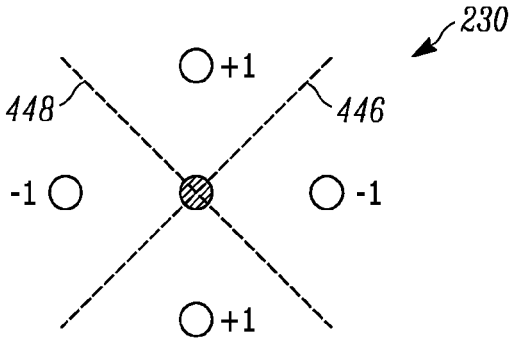
FIG. 3C
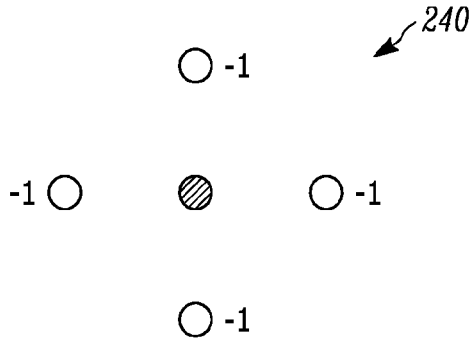
FIG. 3D
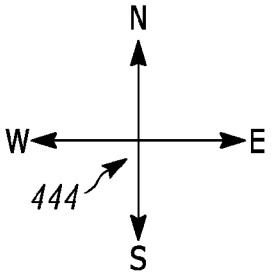

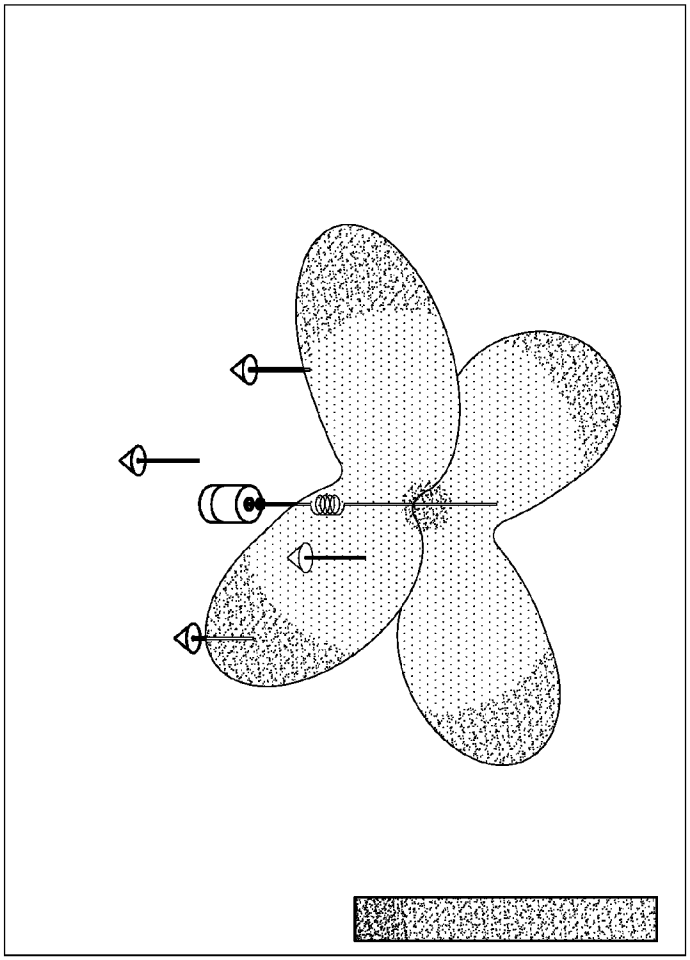
FIG. 7A (210)
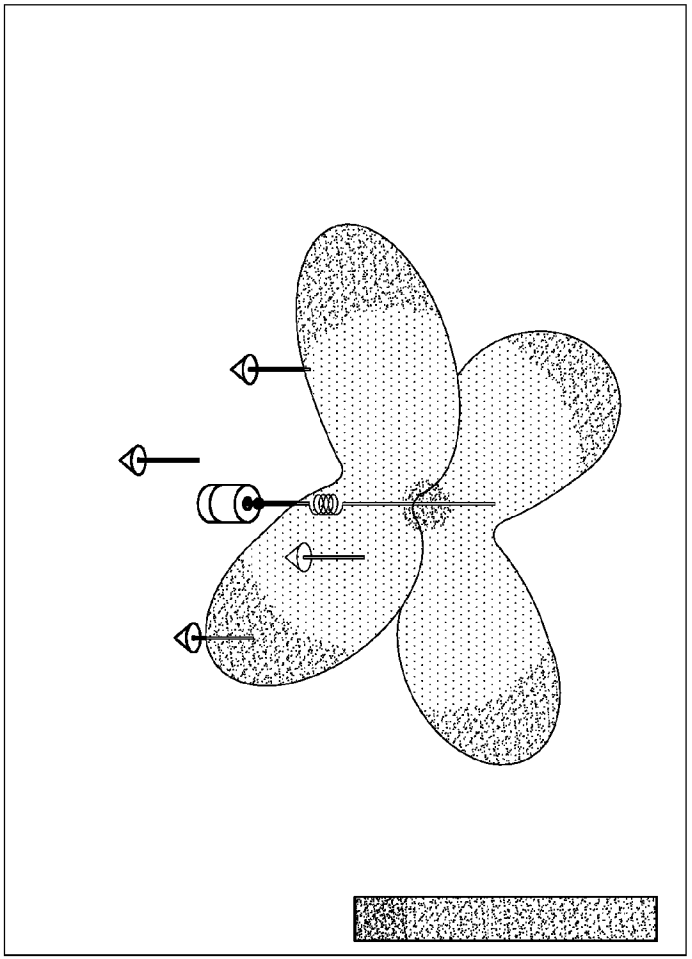
FIG. 7B (220)

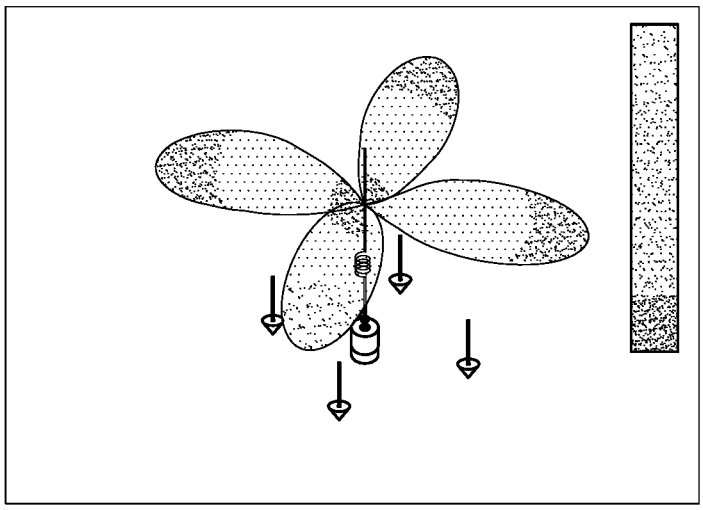
FIG. 7C (230)
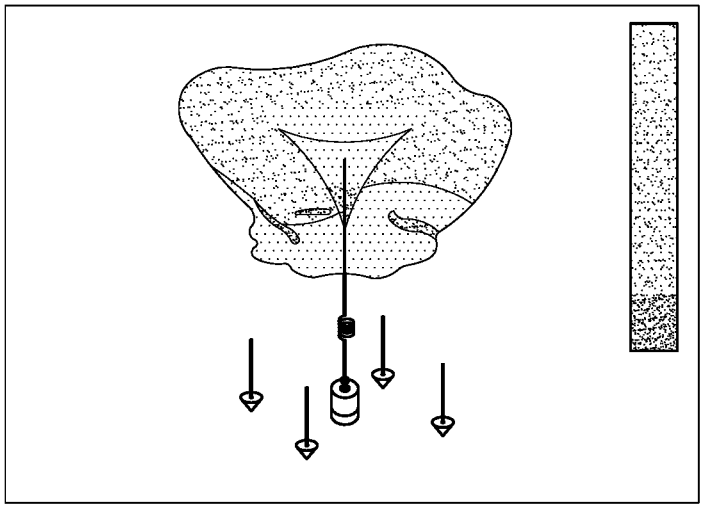
FIG. 7D (240)

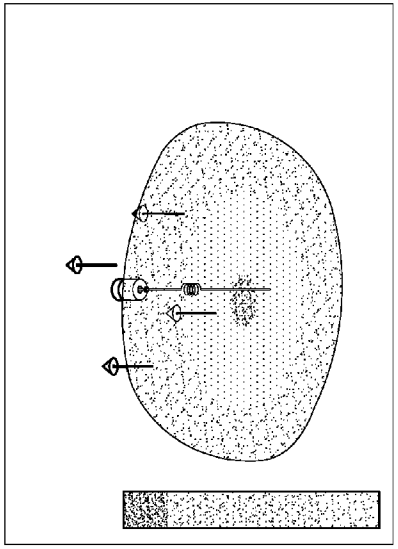
FIG. 7E (LMR)

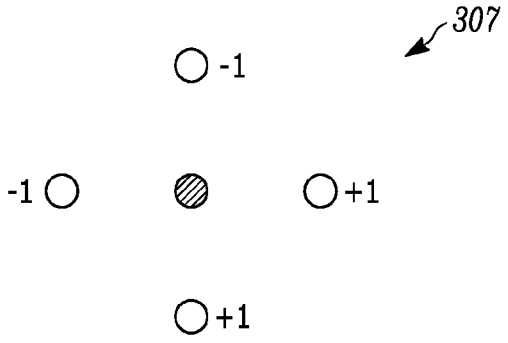
FIG. 9A
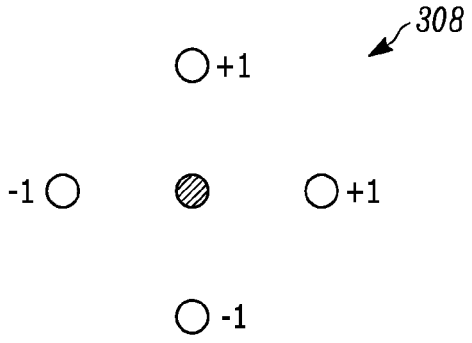
FIG. 9B
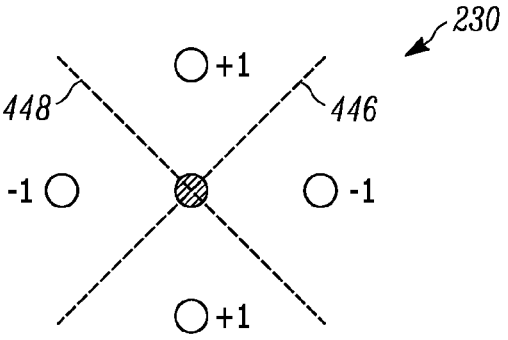
FIG. 9C
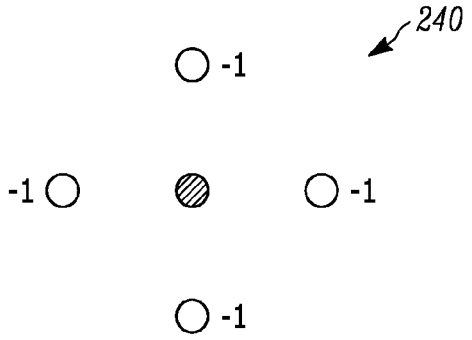
FIG. 9D
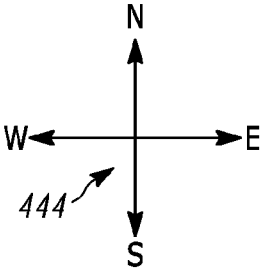

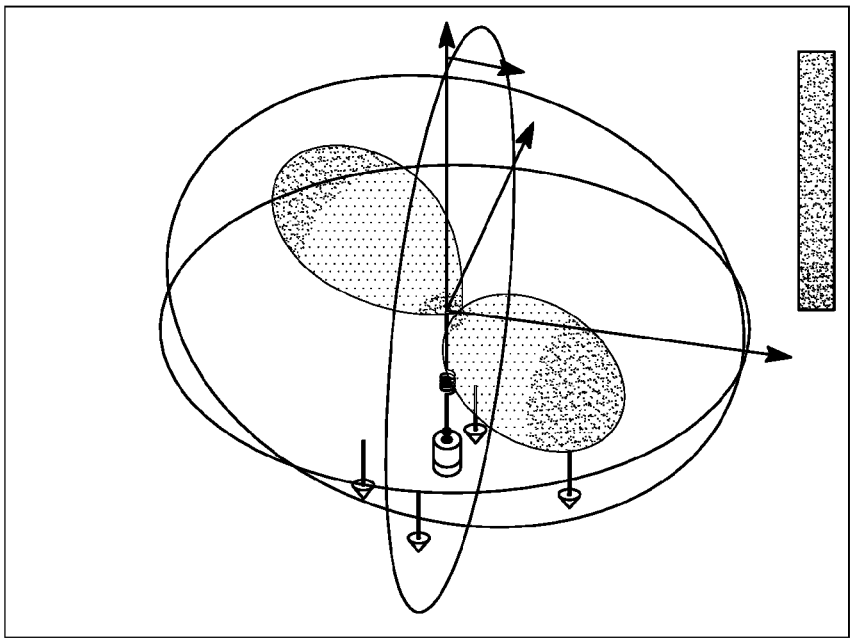
FIG. 13A (307)
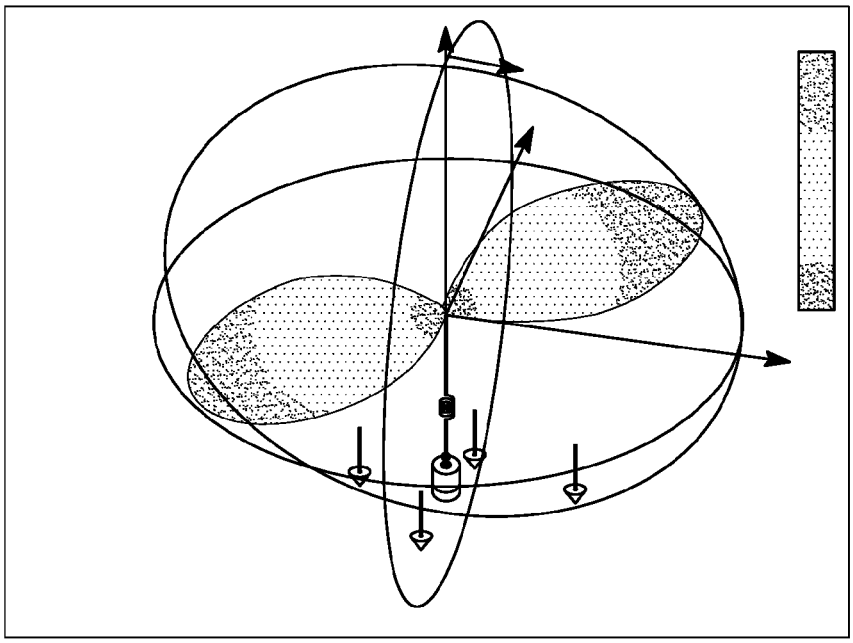
FIG. 13B (308)

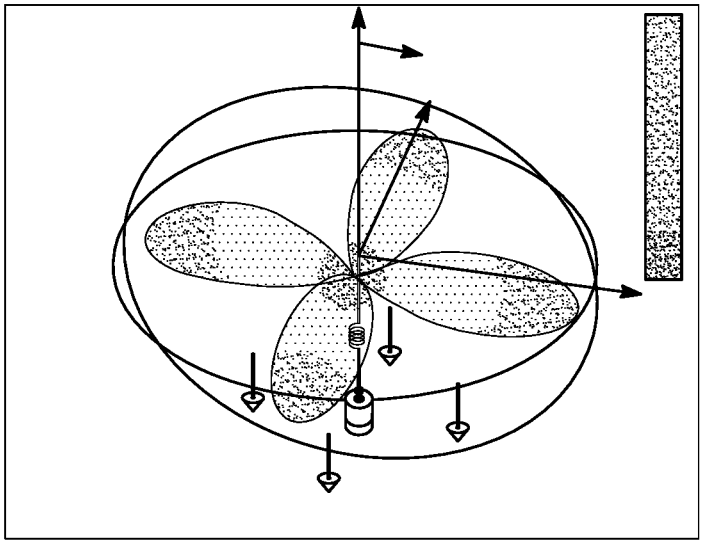
FIG. 13C (230)
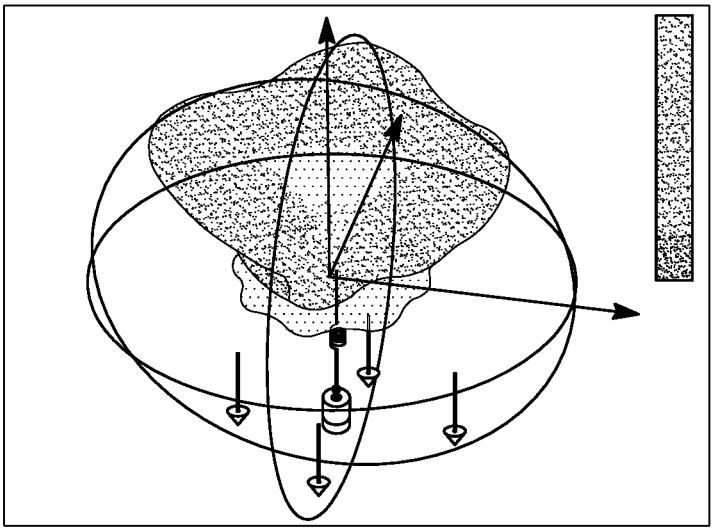
FIG. 13D (240)

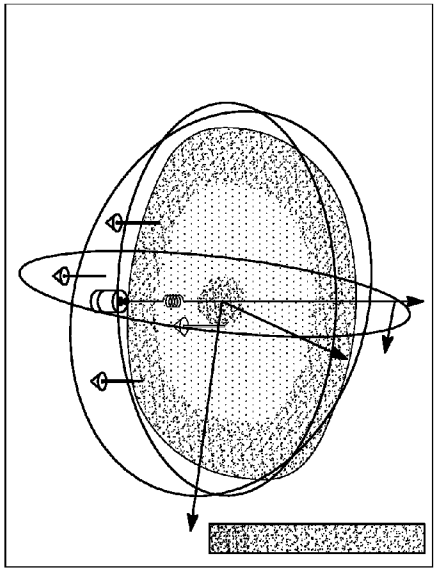
FIG. 13E (LMR)

WIRELESS BROADBAND/LAND MOBILE RADIO ANTENNA SYSTEM

BACKGROUND OF THE INVENTION

The transmission and reception of radio-frequency (RF) signals for use with radios requires the use of antennas. Antenna clusters (for example on a vehicle such as a police vehicle) allow the use of multiple radios (for example two-way radios and cellular telephones). To be effective the antennas cannot interfere with each other. That is, the antennas need to be isolated from one another.

As the quantity of radios, increases, there exists a need to expand the number of available antenna links that can be operated simultaneously.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

FIGS. 3A, 3B, 3C, and 3D show the relative incident-wave phasors synthesized at the four radio-frequency antenna feeding ports of the antenna system of FIG. 2, respectively

FIGS. 7A, 7B, 7C, 7D, and 7E are representations of the radiation patterns for each of the radio connections, and the land-mobile-radio antenna port connection, respectively, of the antenna system of FIG. 2 and a center land-mobile-radio antenna, about a minimum-coupling design frequency.

FIGS. 9A, 9B, 9C, and 9D show the relative incident-wave phasors synthesized at the four radio-frequency antenna feed-point of the antenna system of FIG. 8, respectively.

FIGS. 13A, 13B, 13C, 13D, and 13E are representations of the radiation patterns for each of the radio connections, respectively, of the antenna system of FIG. 8 and a center land-mobile-radio antenna, about a minimum-coupling design frequency.

Figure 1:
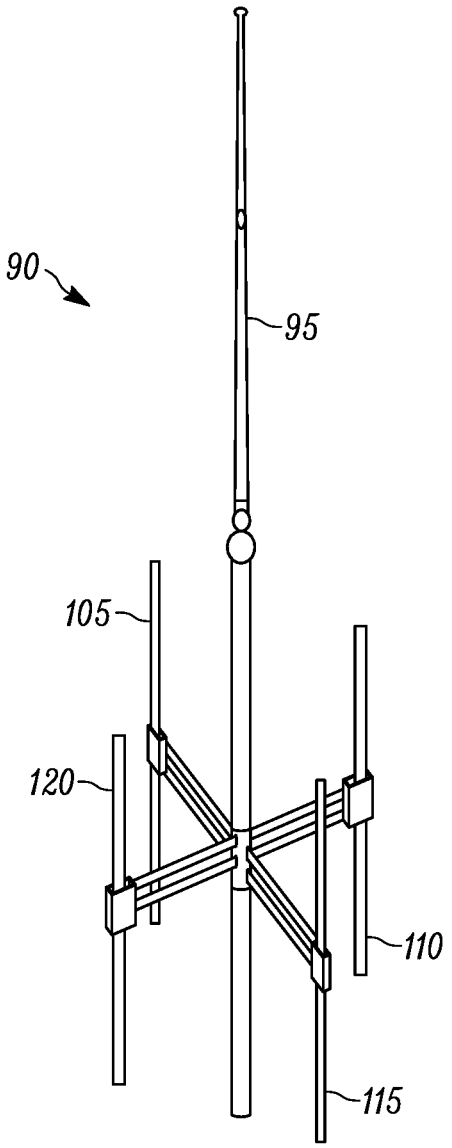
FIG. 1 is a plan view of an antenna system.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

An antenna system includes a central antenna, and a plurality of peripheral antennas positioned symmetrically around the central antenna. A first coupler provides a first radio connection and a second radio connection. A first 180 degree hybrid coupler is coupled to a first two diametrically opposed antennas of the plurality of peripheral antennas. A second 180 degree hybrid coupler is coupled to a second two diametrically opposed antennas of the plurality of peripheral antennas. A third 180-degree hybrid coupler is coupled to the first and second 180-degree hybrid couplers and provides a third radio connection and a fourth radio connection. The first, second, third, and fourth radio connections are decoupled from each other, and the first, second, and third radio connections are also decoupled from the central antenna.

FIG. 1 is a plan view of an antenna cluster 90 including a central antenna 95 surrounded by opposing pairs of equi-distant antennas 105, 110, 115, and 120.

Figure 2:
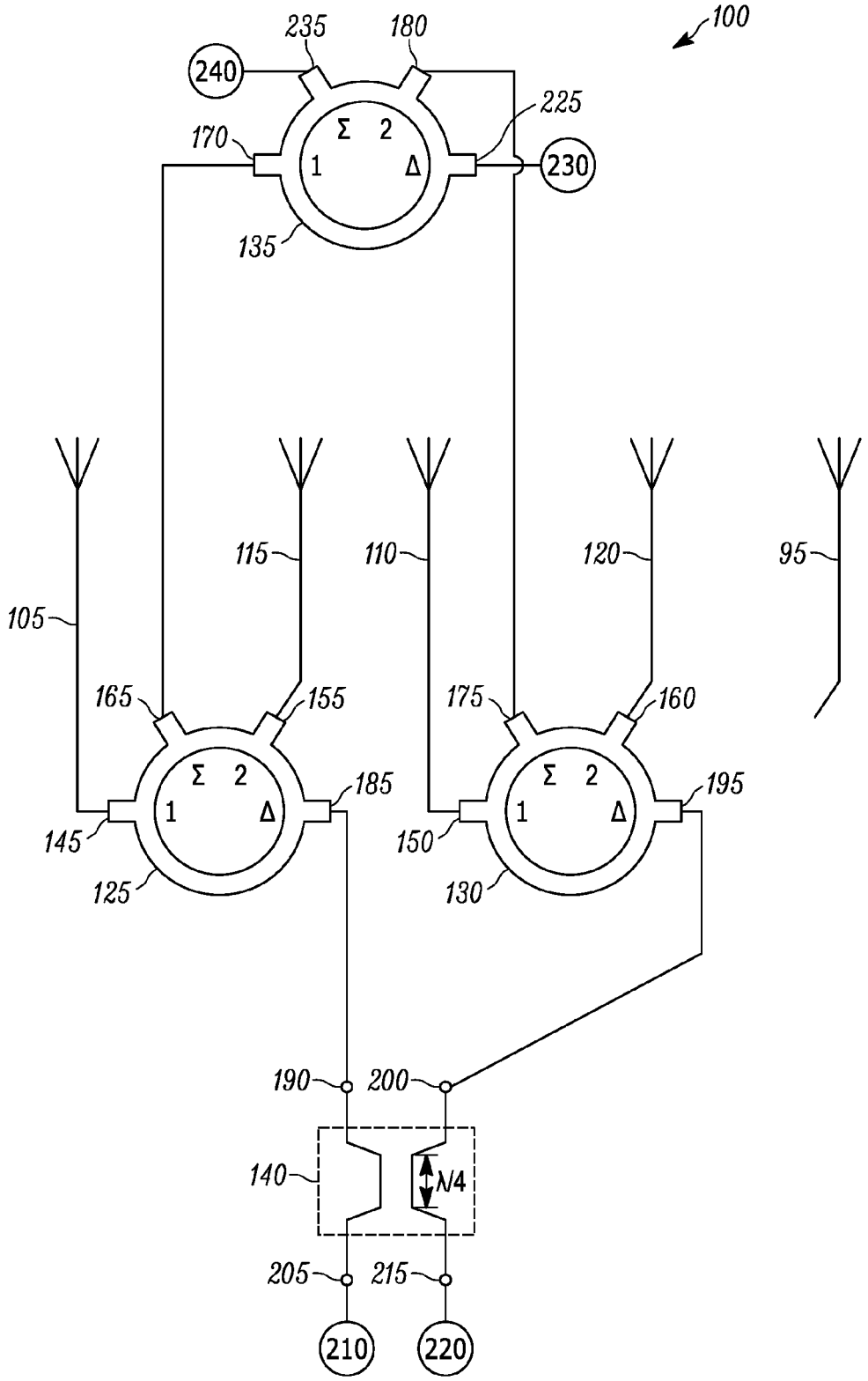
FIG. 2 is a schematic diagram of an antenna system in accordance with an embodiment.

FIG. 2 is a schematic diagram of an antenna system 100 (incorporating the central antenna 95 and multiple peripheral antennas symmetrically positioned around the central antenna). The antenna system 100 includes a first antenna 105, a second antenna 110, a third antenna 115, a fourth antenna 120, a first 180 degree hybrid coupler 125, a second 180 degree hybrid coupler 130, a third 180 degree hybrid coupler 135, and a 90 degree hybrid coupler 140. The first through fourth antennas 105, 110, 115, and 120 provide wireless broadband communication links (such as cellular communication including Long-Term Evolution communication). The central antenna 95 provides a radio frequency communication link (such as a Land-Mobile-Radio link).

The first through fourth antennas 105, 110, 115, and 120 are symmetrically positioned (i.e., orthogonally) around the central antenna approximately 90 azimuth degrees apart (i.e., about a rotation axis coinciding with the vertical extension of central antenna 95 shown in FIG. 1). The first and third antennas 105 and 115 are diametrically opposed (i.e., 180 degrees apart) and the second and fourth antennas 110 and 120 are also diametrically opposed.

The first antenna 105 is coupled to a first node 145 of the first 180 degree hybrid coupler 125. The second antenna 110 is coupled to a first node 150 of the second 180 degree hybrid coupler 130. The third antenna 115 is coupled to a second node 155 of the first 180 degree hybrid coupler 125. The fourth antenna 120 is coupled to a second node 160 of the second 180 degree hybrid coupler 130.

A third node 165 (for example, a summing node) of the first 180 degree hybrid coupler 125 is coupled to a first node 170 of the third 180 degree hybrid coupler 135. A third node 175 (for example, a summing node) of the second 180 degree hybrid coupler 130 is coupled to a second node 180 of the third 180 degree hybrid coupler 135.

A fourth node 185 (for example, a difference node) of the first 180 degree hybrid coupler 125 is coupled to a first node 190 of the 90 degree hybrid coupler 140. A fourth node 195 (for example, a difference node) of the second 180 degree hybrid coupler 130 is coupled to a second node 200 of the 90 degree hybrid coupler 140.

A third node 205 of the 90 degree hybrid coupler 140 provides a first radio connection 210. A fourth node 215 of the 90 degree hybrid coupler 140 provides a second radio connection 220. A third node 225 (for example, a difference node) of the third 180 degree hybrid coupler 135 provides a third radio connection 230. A fourth node 235 (for example, a summing node) of the third 180 degree hybrid coupler 135 provides a fourth radio connection 240.

The result is four separate radio connections (i.e., radio-frequency ports) that are substantially decoupled from each other. "Substantially decoupled" as used herein means that the signals at the antennas, while having some overlap, have sufficient separation that the signals can be separated from one another. That is, a signal sent/received at one antenna does not impact a signal sent/received at another antenna. Three of the four radio-frequency ports are also substantially decoupled from the central land-mobile-radio antenna, with the fourth radio-frequency port substantially coupled (i.e., signal overlap) to the central land-mobile-radio antenna.

FIGS. 3A, 3B, 3C, and 3D show the excitation profiles, expressed in terms of relative "incident wave" complex amplitudes, produced by the four radio connections 210, 220, 230, and 240 at the four peripheral radio-frequency antenna feed-points. These incident-wave amplitudes are represented by phasors, which in circuit theory terms provide both magnitude and phase information at the feed-points of the various antenna elements. It is understood that the phasor values depend on the length of the interconnections between the various couplers in FIG. 2 and between them and the antennas, therefore it is understood that the use of purely real or imaginary phasor values in the foregoing and in the following is for convenience and it is meant to illustrate the relative phase differences between the incident waves at each antenna, whose magnitudes are similar about the system design frequency where the couplers' behaviors approach the ideal (i.e., 100 percent isolation). Thus, an arbitrary time reference, and a zero-electrical-length connection between couplers and antennas, is implied in order for these phasors to be purely real or imaginary, simplifying the graphical notation. Phasors that differ only for their respective sign are in opposing phase, and their sum is zero. In FIGS. 3A-3D and the description below, the first antenna 105 is referred to as "north," the second antenna 110 is referred to as "east," the third antenna 115 is referred to as "south," and the fourth antenna 120 is referred to as "west." This notation (north, south, east, and west) is for clarity in explaining the figures and does not indicate an actual directional placement of the antennas. A central land-mobile-radio antenna is in the center of this cardinal reference frame, said reference frame lying on top of the so-called azimuth plane 444.

As shown in FIGS. 3A and 3B, the antenna feeding scheme realizes clock- and, respectively, counter-clock-wise equi-amplitude feeding profiles with increasing or, respectively, decreasing phase (90-degree steps). The phasors (+j and −j) represent incident waves that are 90 degree off (i.e., in quadrature) relative to phasors 1 and −1. Because of symmetries, the same fraction "w" (i.e., the "scattering coefficient") of the incident wave at each peripheral antenna feed-point couples into the central land-mobile-radio antenna. Therefore, due to superposition of effects, the total coupled signal into the central antenna, going north-east-south-west, is: $w(+1)+w(+j)+w(-1)+w(-j)=0$ for the first radio connection 210 (FIG. 3A). For the second radio connection 220 (FIG. 3B), going north-east-south-west in the figure, the total coupled signal into the central antenna is: $w(+j)+w(+1)+w(j)+w(-1)=0$, resulting in no coupling between the first and second radio connections 210 and 220 and the land-mobile-radio antenna. Thus, a signal cancellation scheme based on geometrical symmetries and the synthesized antenna feeding profiles is realized.

As shown in FIG. 3C, the east and west antennas are in phase, and feature opposing phase with respect to the north and south antennas (which are also in phase). Because of symmetries, the signal induced by the radio connections and the central land-mobile-radio antenna have the same magnitude, but alternating phase (sign) since the antennas are fed with alternating-sign incident-wave amplitudes (phasors). Thus, north-east-south-west superposition is: $w(+1)+w(-1)+w(+1)+w(-1)=0$, resulting in no coupling between the radio connection 230 and the land-mobile-radio antenna; and, thus, cancellation. The alternating-sign incident-wave amplitude profile causes substantial signal cancellation across the entire plane 446 (dotted line) crossing from southwest to northeast, said plane being a first elevation plane which is orthogonal to the azimuth plane 444, as well as across the entire plane 448 (dotted line) crossing from northwest to southeast, said plane being a second elevation plane which is orthogonal to both the azimuth plane 444 and the first elevation plane 446. Signal cancellation across these two elevation planes causes deep nulls in the corresponding radiation pattern, shown later.

However, as shown in FIG. 3D, the north, east, south, and west antennas are in phase between them. Thus, the incident-wave amplitudes (phasors) north-east-south-west are: $w(-1)+w(-1)+w(-1)+w(-1)=-4w$, resulting in substantial coupling between the radio connection and the land-mobile-radio antenna.

The central antenna, is not perfectly decoupled from the fourth radio connection 240 because signals arriving from the fourth radio connection 240 impinge in-phase at the peripheral antenna feed-points and thus combine in-phase at the central antenna.

Limited to the bandwidth of the wireless broadband antenna system, the fourth radio connection 240 may also be used to operate a land-mobile-radio with a different radiation pattern (for instance, up-tilt) which may be advantageous in hi-rise urban environment, for example, downtown Manhattan, N.Y.

Figure 4:
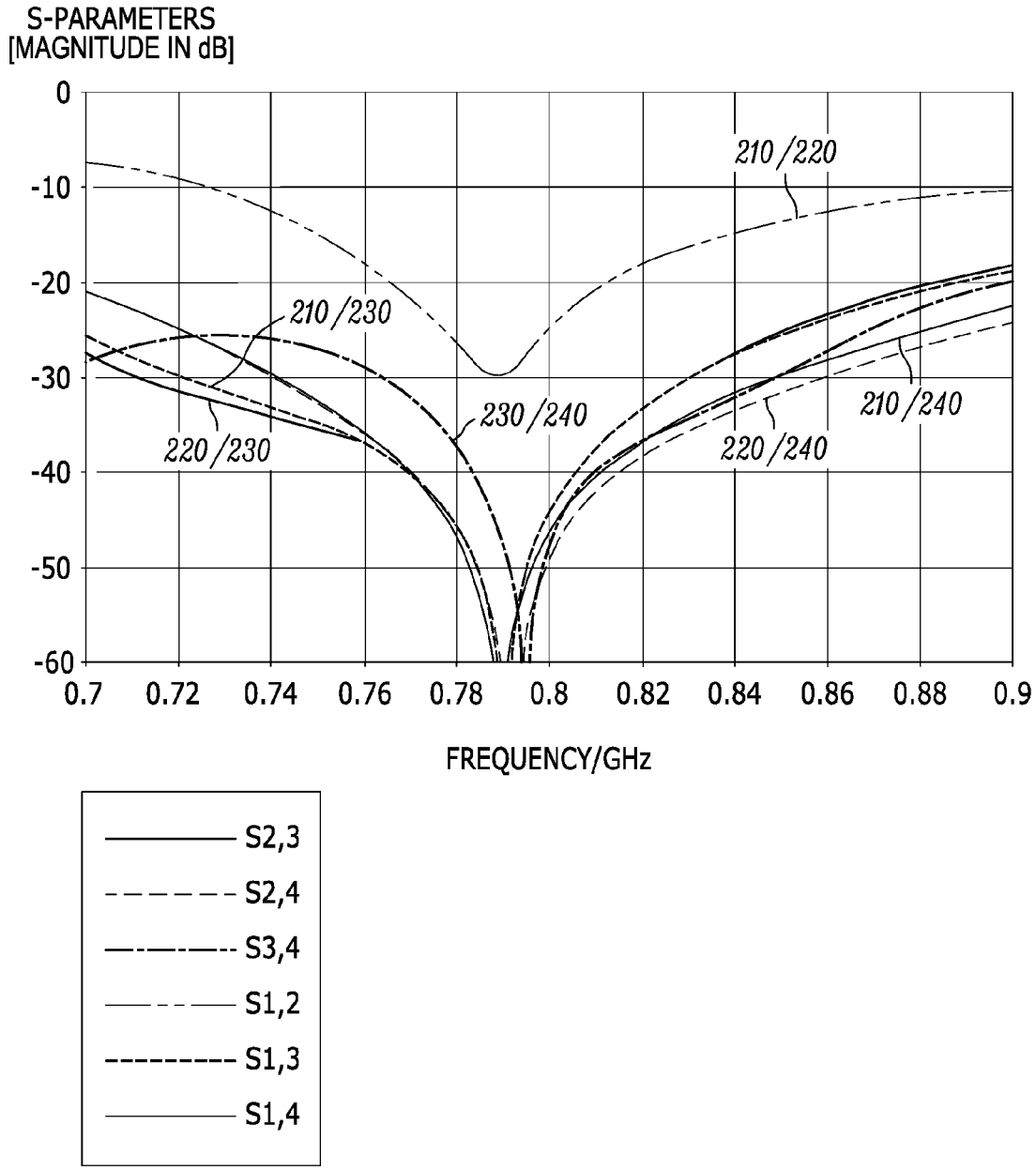
FIG. 4 is a graph illustrating the coupling between the four radio connections of the antenna system of FIG. 2, about a minimum-coupling design frequency.

FIG. 4 is a graph illustrating the radio-frequency coupling between the radio connections 210, 220, 230, and 240. The high level of isolation between the radio connection 210, 220, 230, and 240 indicates a low radiation pattern correlation, a highly desirable trait in multiple-input multiple-output (MIMO) wireless communication systems, and allows the elimination of duplexers.

Figure 5:
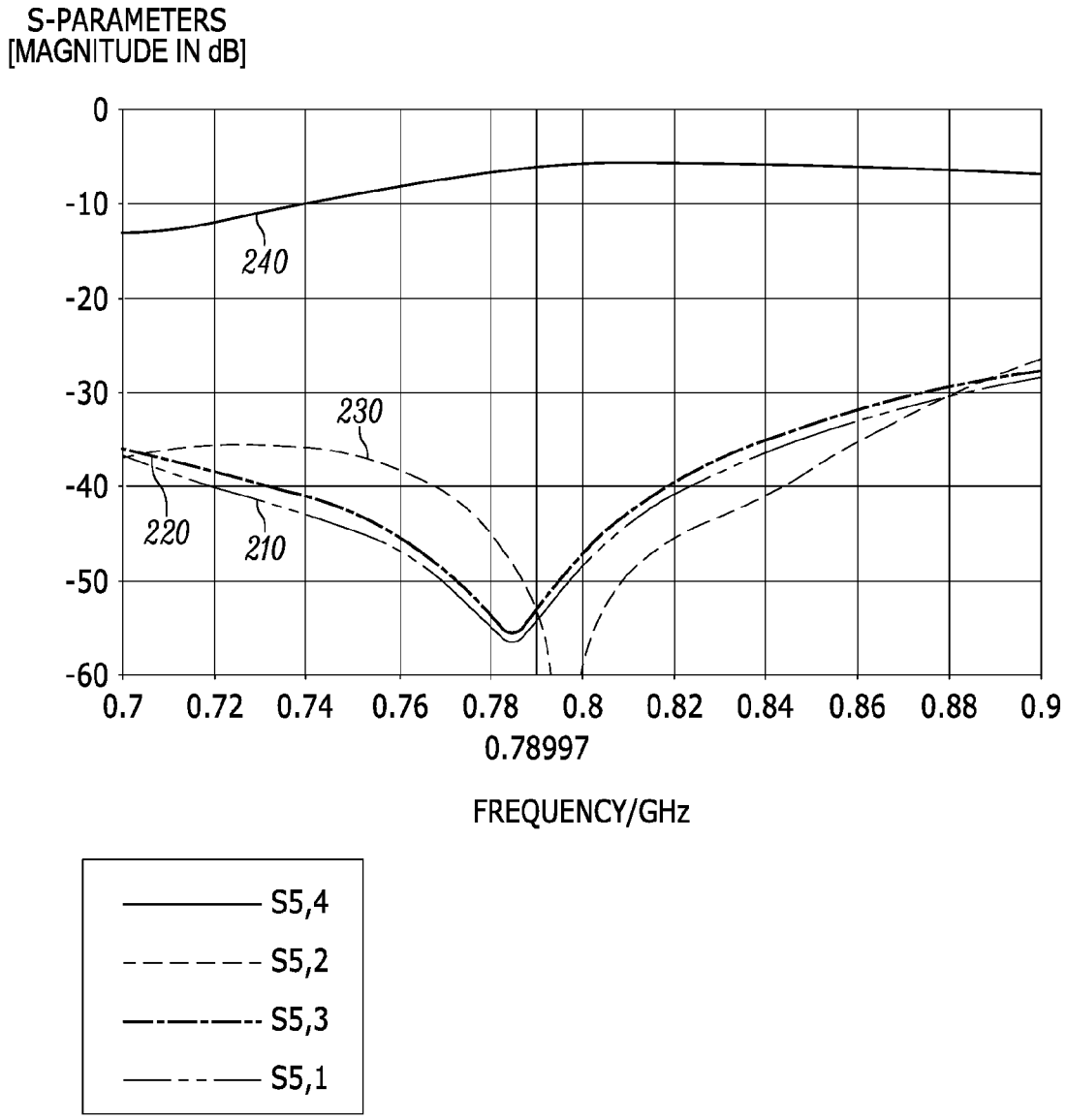
FIG. 5 is a graph illustrating the coupling between each of the radio connections of the antenna system of FIG. 2. and a center land-mobile-radio antenna, about a minimum-coupling design frequency.

FIG. 5 is a graph illustrating the coupling between each of the radio connections 210, 220, 230, and 240 and the central land-mobile-radio antenna. As the graph shows, the fourth radio connection 240 is substantially coupled with the land-mobile-radio antenna.

Figure 6:
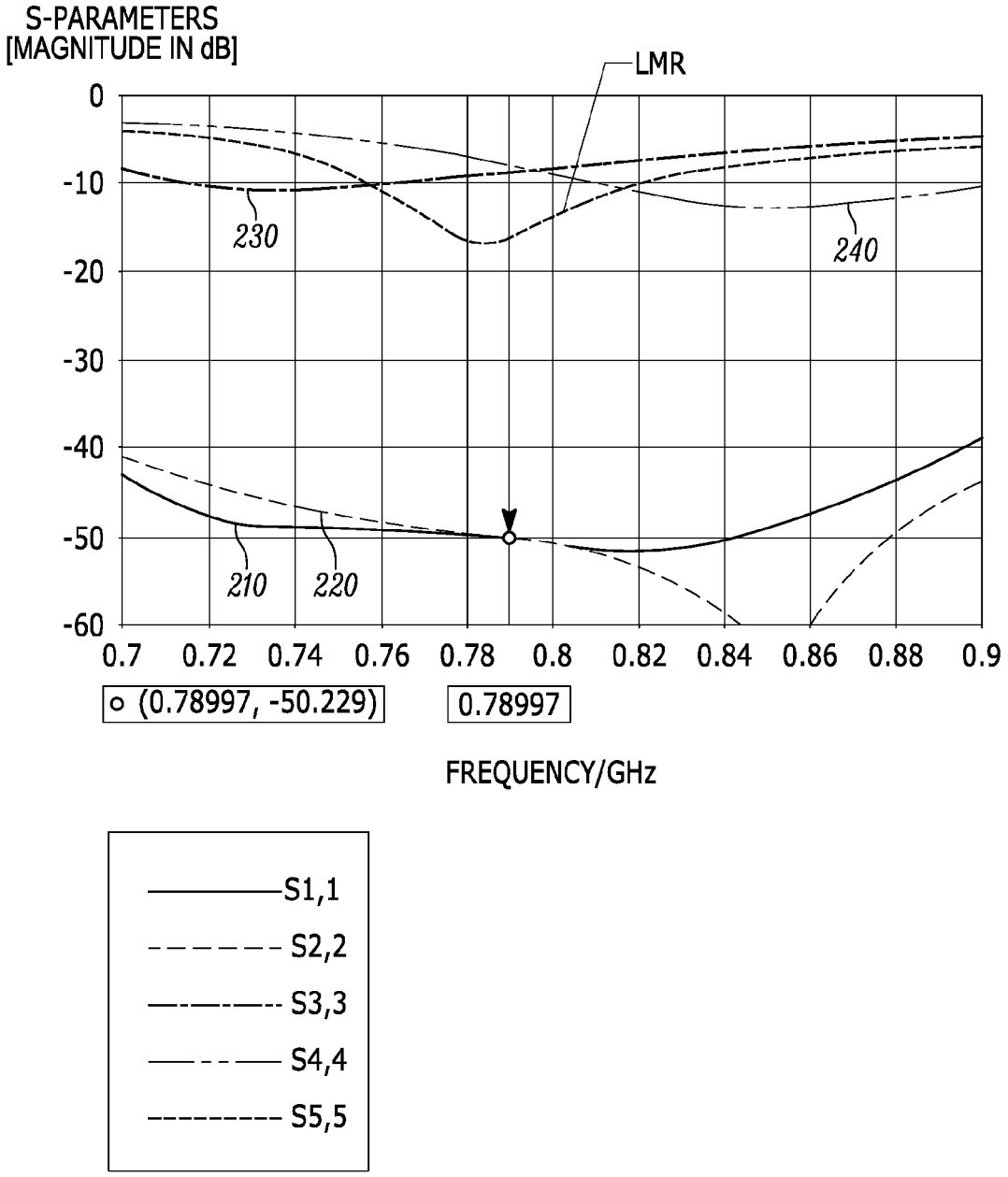
FIG. 6 is a graph illustrating the return losses for each of the radio connections of the antenna system of FIG. 2 and a center land-mobile-radio antenna, about a minimum-coupling design frequency.

FIG. 6 is a graph illustrating the return losses for each of the radio connections 210, 220, 230, and 240, and the central land-mobile-radio antenna (no radio-frequency impedance matching circuit is employed at the radio connection ports or at the antenna feed-points).

FIGS. 7A, 7B, 7C, 7D, and 7E are tri-dimensional representations of the radiation patterns for each of the radio connections 210, 220, 230, and 240, and the central land-mobile-radio antenna, respectively. Antenna system 100 is installed over a metal ground plane. Although it is not readily seen by the representations, the first and second radio connections 210 and 220 are decoupled due to opposing phase rotation versus azimuth of the radiated field even though they feature similarly-shaped gain patterns, the third radio connection 230 features deep nulls and is rotated approximately 45 degrees in azimuth relative to the radio connections 210 and 220 patterns, the fourth radio connection 240 features an up-tilt pattern due in part to the substantial electromagnetic coupling with the central land-mobile-radio antenna, and the land-mobile-radio antenna has a substantially omnidirectional, high-gain radiation pattern pointing towards the horizon (azimuth plane).

Figure 8:
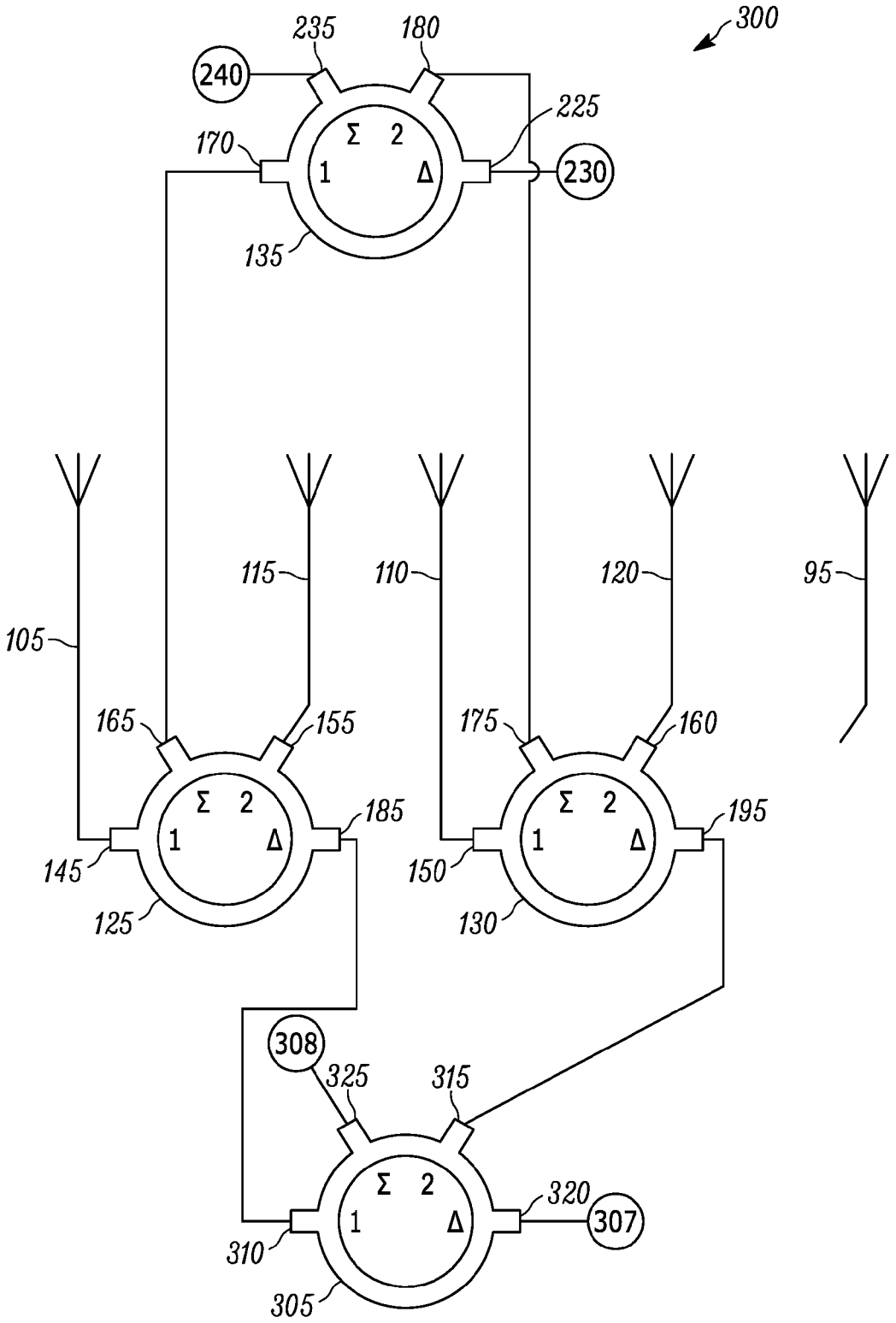
FIG. 8 is a schematic diagram of an antenna system in accordance with a second embodiment.

FIG. 8 is a schematic diagram of a second embodiment of an antenna system 300. The antenna system 300 is similar to the antenna system 100 with the exception that the 90 degree hybrid coupler 140 of antenna system 100 is replaced by a fourth 180 degree hybrid coupler 305. In this embodiment, instead of the rotating-phase modes, first and second radio connections 307 and 308 excite mutually orthogonal differential modes, each featuring pairs of adjacent antennas being excited by same-phase incident waves at the respective feed-points.

The fourth node 185 (i.e., a difference node) of the first 180 degree hybrid coupler 125 is coupled to a first node 310 of the fourth 180 degree hybrid coupler 305, and the fourth node 195 (i.e., a difference node) of the second 180 degree hybrid coupler 130 is coupled to a second node 315 of the fourth 180 degree hybrid coupler 305. A third node 320 (for example, a difference node) of the fourth 180 degree hybrid coupler 305 provides the first radio connection 307. A fourth node 325 (for example, a summing node) of the fourth 180 degree hybrid coupler 305 provides the second radio connection 308.

FIGS. 9A, 9B, 9C, and 9D show the four excitation profiles, expressed in terms of relative "incident wave" complex amplitudes, produced by the four radio connections 307, 308, 230, and 240 at the four peripheral radio-frequency antenna feed-points. In FIGS. 9A through 9D and the description below, the first antenna 105 is referred to as "north," the second antenna 110 is referred to as "east," the third antenna 115 is referred to as "south," and the fourth antenna 120 is referred to as "west." A central land-mobile-radio antenna is in the center of this cardinal reference frame.

In both FIGS. 9A and 9B, which represent visually the antenna feed-point incident-wave profiles (featuring substantially the same magnitude about a minimum-coupling design frequency) corresponding to radio connections 307 and 308, respectively, the east and west antennas are out of phase between them, and the north and south antennas are also out of phase with each other. However, in FIG. 9A, corresponding to radio connection 307, the north and west antennas are in phase, while the south and east antennas are in opposite phase relative to north and west antennas, thus effecting radio-frequency signal cancellation over the entire first elevation plane 446 (dotted line) crossing from southwest to northeast. Instead, in FIG. 9B the south and west antennas are in phase, while the north and east antennas are mutually in-phase but in opposite phase relative to south and west antennas, thus realizing signal cancellation over the entire second elevation plane (dotted line) 448 crossing from southeast to northwest. Because of symmetries, the signal induced by the radio connections in the central land-mobile-radio antenna vanishes since the radio connections 307 and 308 produce an equal number of opposite-sign incident-wave amplitudes (phasors) at the antenna feedpoints. Thus, in FIG. 9A, north-east-south-west superposition gives: $w(-1)+w(+1)+w(+1)+w(-1)=0$, resulting in no coupling between the radio connection and the land-mobile-radio antenna, and in FIG. 9B, north-east-south-west superposition gives: $w(+1)+w(+1)+w(-1)+w(-1)=0$, resulting in no coupling between the radio connection and the land-mobile-radio antenna.

The antenna feed-point incident-wave profiles shown in FIGS. 9C and 9D are the same as in FIGS. 3C and 3D above.

Figure 10:
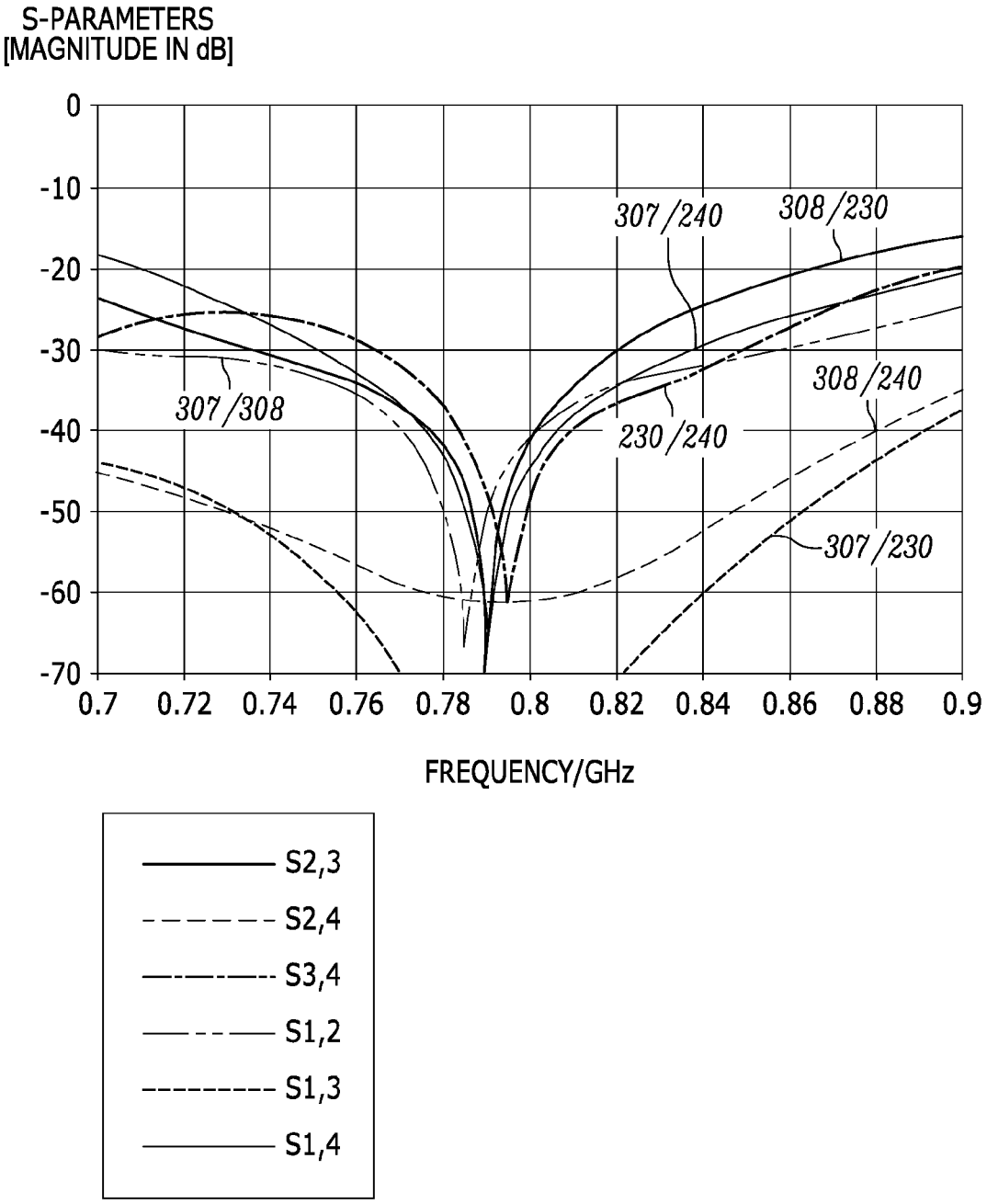
FIG. 10 is a graph illustrating the coupling between the four radio connections of the antenna system of FIG. 8, about a minimum-coupling design frequency.

FIG. 10 is a graph illustrating the coupling between the radio connections 307, 308, 230, and 240 for antenna system 300. The high level of isolation between the couplings indicates a low radiation pattern correlation, a highly desirable trait, and allows the elimination of duplexers.

Figure 11:
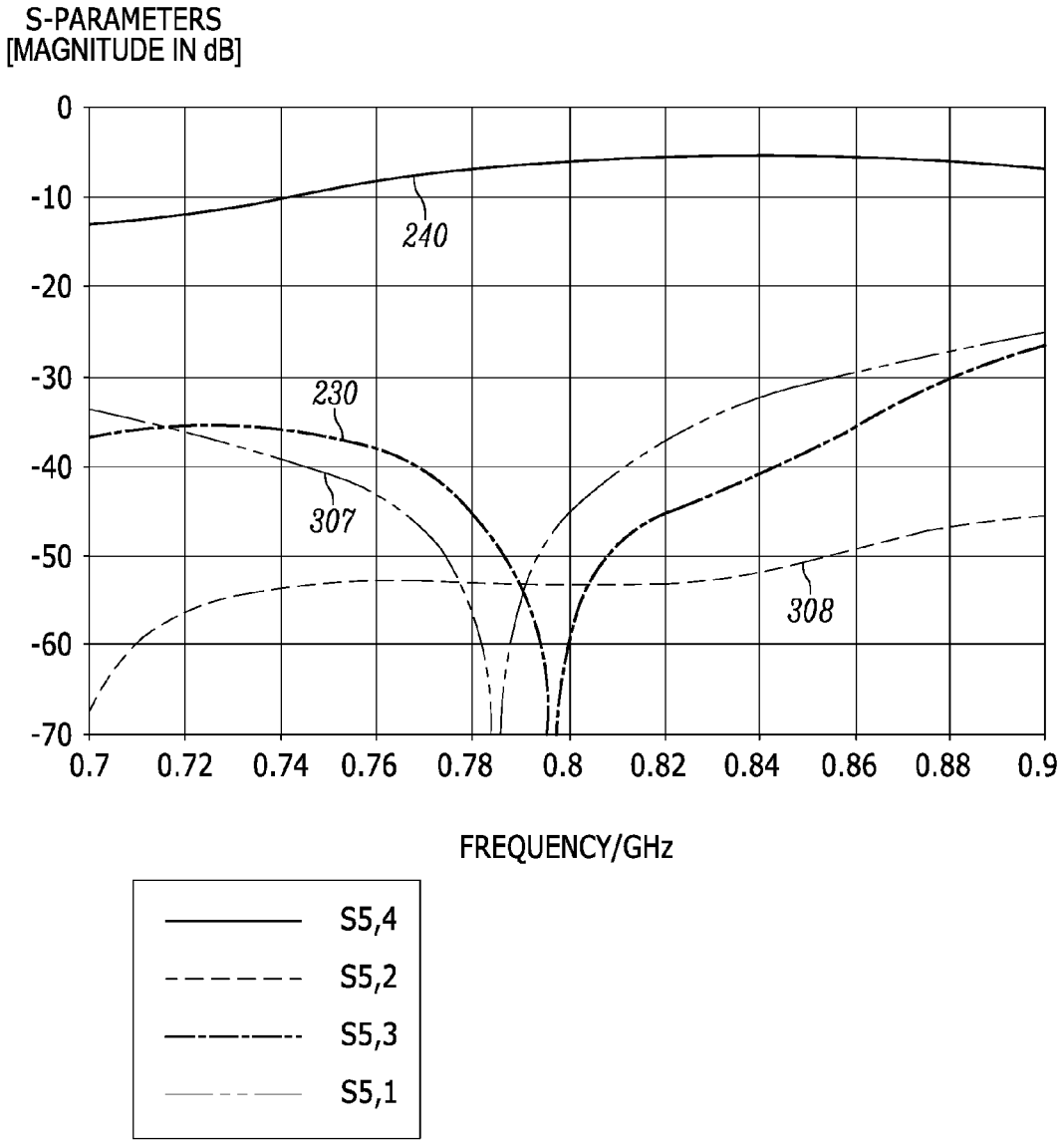
FIG. 11 is a graph illustrating the coupling between each of the radio connections of the antenna system of FIG. 8 and a center land-mobile-radio antenna, about a minimum-coupling design frequency.

FIG. 11 is a graph illustrating the coupling between each of the radio connections 307, 308, 230, and 240 and the central land-mobile-radio antenna for antenna system 300. As the graph shows, the fourth radio connection 240 is substantially coupled with the land-mobile-radio antenna.

Figure 12:
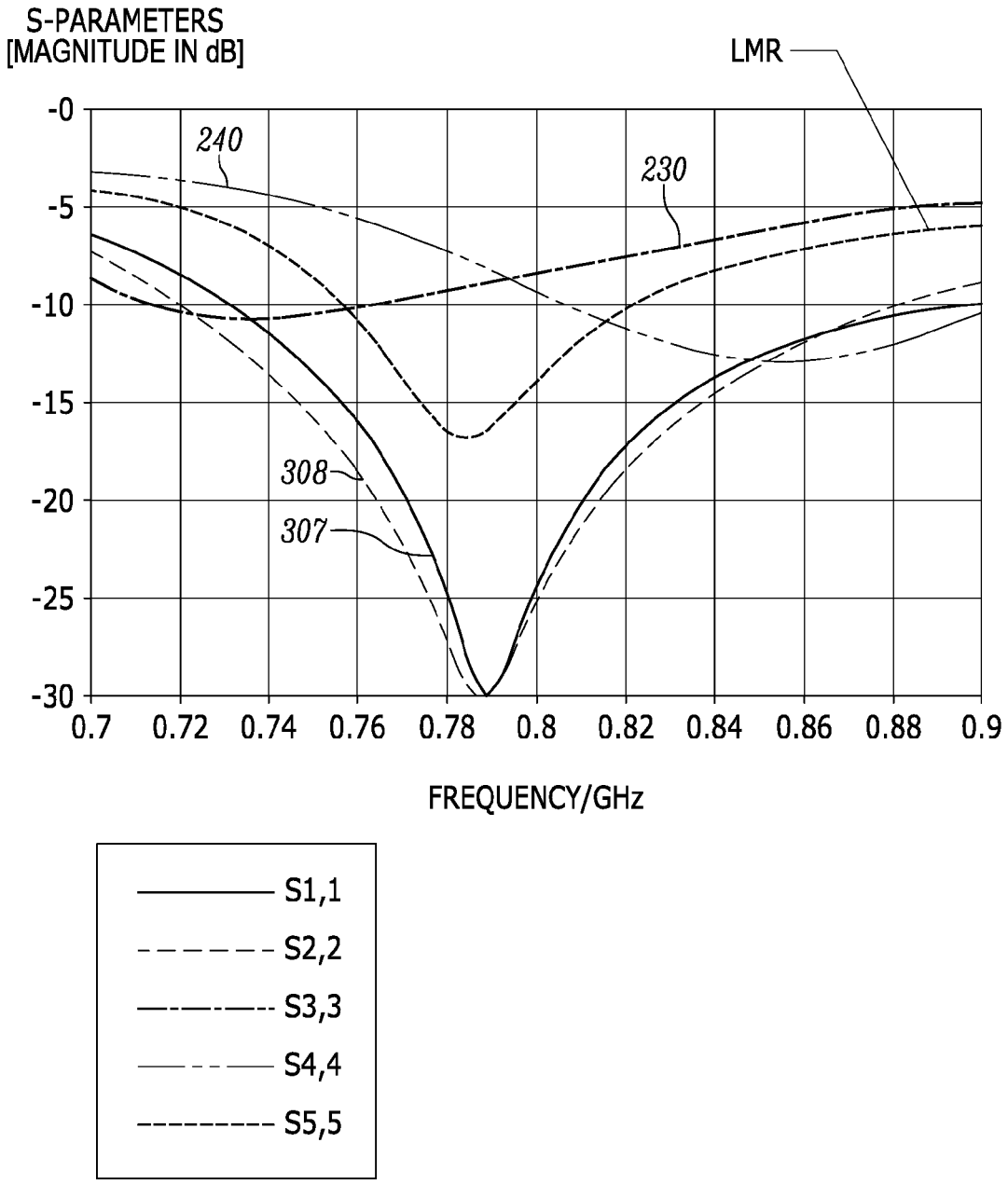
FIG. 12 is a graph illustrating the return losses for each of the radio connections of the antenna system of FIG. 8 and a center land-mobile-radio antenna, about a minimum-coupling design frequency.

FIG. 12 is a graph illustrating the return losses for each of the radio connections 307, 308, 230, and 240, and for the land-mobile-radio antenna for antenna system 300 (also in this case, no radio-frequency impedance matching circuit is employed at the radio connection ports or at the antenna feed-points).

FIGS. 13A, 13B, 13C, 13D, and 13E are representations of the radiation patterns for each of the radio connections 307, 308, 230, and 240, and the central land-mobile-radio antenna for antenna system 300, respectively. Antenna system 300 is installed over a metal ground plane. As can be seen from the representations, the first and second radio connections 307 and 308 are decoupled due to orthogonal differential modes featuring nulls across the aforementioned planes, the third radio connection 230 features deep nulls between four lobes as it did for antenna system 100, the fourth radio connection 240 has an up-tilt pattern and due in part to the substantial electromagnetic coupling with the central land-mobile-radio antenna as it did for antenna system 100, and the land-mobile-radio antenna has a substantially omnidirectional, high-gain radiation pattern pointing towards the horizon (azimuth plane).

FIG. 14*s* a block diagram of a wireless broadband/Land-Mobile-Radio system 400 capable of 1×2 multiple-input/multiple-output (MIMO) communication using the antenna systems 100 and 300. A wireless broadband circuit 405 (for example, an application-specific integrated-circuit, or ASIC) has a first transmit node 410 coupled to the first radio connection 210/307, a primary receive node 415 coupled to the second radio connection 220/308, and a secondary receive node 420 coupled to the third radio connection 230.

A land-mobile-radio circuit 425 is coupled to a switch 430 (for example, a single-pole-double-throw relay having a pole 431, a first throw 432, and a second throw 433) which is also coupled to the fourth radio connection 240 and to the central land-mobile-radio antenna 95. A controller 435 controls operation of the wireless broadband and land-mobile-radio circuits 405 and 425 and the switch 430.

In the wireless broadband/Land-Mobile-Radio 400, no duplexer is needed for the wireless broadband signals thanks to low coupling between radio connections 210/307, 220/308, 230. The radio-frequency port 240 provides a superior up-tilt pattern which may be advantageous in hi-rise building environments to increase the dependability of Land-Mobile Radio communication systems coverage. The controller 435 controls the switch 430 coupling the land-mobile-radio circuit 425 to the land-mobile-radio antenna for better horizontal communication, and coupling the land-mobile-radio circuit 425 to the fourth radio connection 240, for better up-tilt communication in hi-rise building environments.

Figure 15:
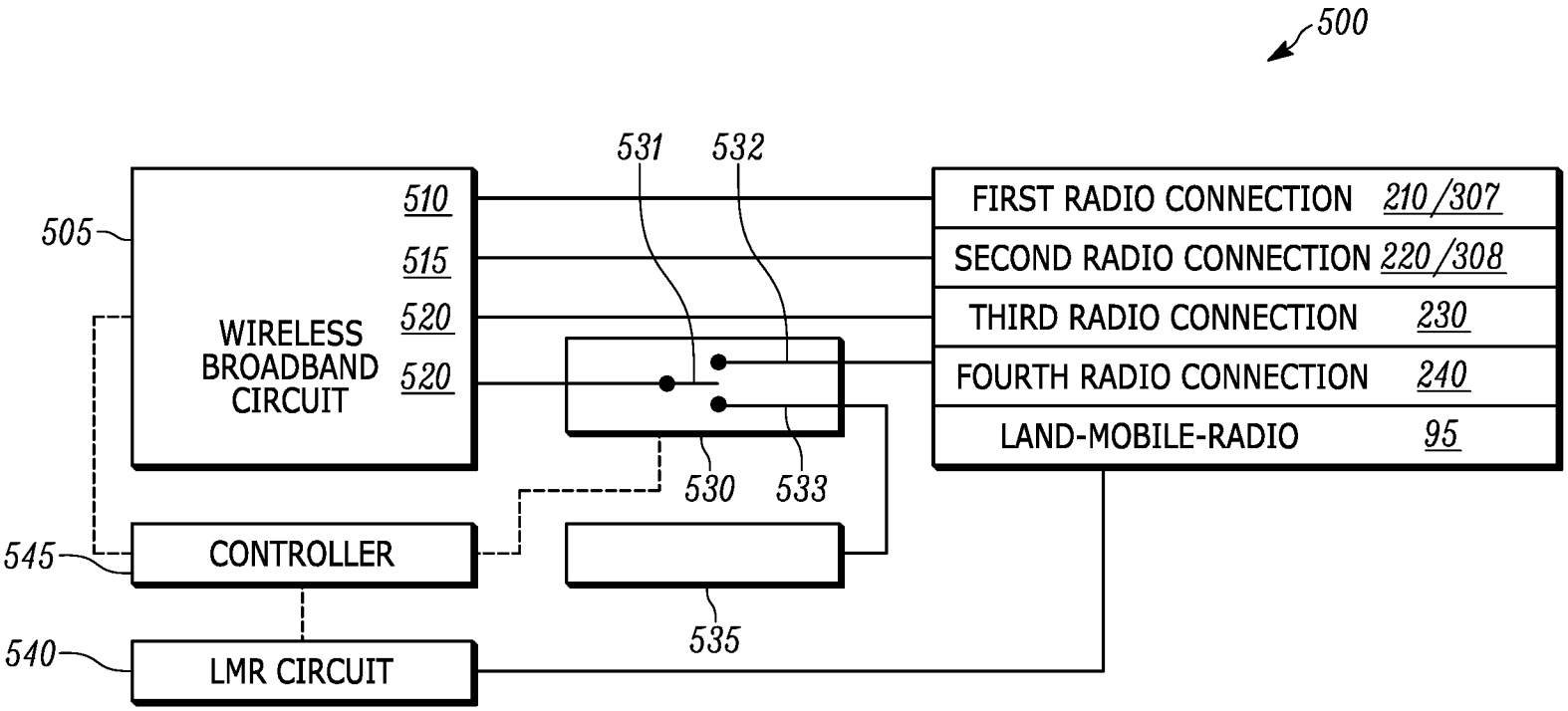
FIG. 15 is a block diagram of a Wireless broadband/Land-Mobile-Radio system capable of a 2×2 multiple-input/multiple-output (MIMO) communication using the antenna systems of FIG. 2 or 8.

FIG. 15 is a block diagram of a wireless broadband/Land-Mobile-Radio system 500 capable of 2×2 multiple-input/multiple-output (MIMO) communication using the antenna systems 100 and 300. A wireless broadband circuit 505 (for example, an ASIC) has a first transmit node 510 coupled to the first radio connection 210/307, a first receive node 515 coupled to the second radio connection 220/308, a second receive node 520 coupled to the third radio connection 230, and a second transmit node 525 coupled to a switch 530 (for example, a single-pole-double-throw relay having a pole 531, a first throw 532, and a second throw 533) which is also coupled to the fourth radio connection 240 and a passive load 535.

A land-mobile-radio circuit 540 is coupled to the land-mobile-radio antenna. A controller 545 controls operation of the wireless broadband and land-mobile-radio circuits 505 and 540 and the switch 530.

In the wireless broadband/Land-Mobile-Radio system 500, no duplexers are needed for the wireless broadband signals because ports 210/307, 220/308, 230, 240 are mutually decoupled. When the land-mobile-radio circuit 540 is communicating, for instance in push-to-talk simplex mode used in many public safety dispatch radio systems, the switch 530 couples the fourth radio connection 240 to the passive load 535 and disconnects the second transmit node 525, thus eliminating the central land-mobile-radio antenna interference on the second transmit node 525, which may cause malfunction or even damage if the radio-frequency power coupled from the land-mobile-radio antenna to said transmitter circuitry is substantial. When the land-mobile-radio circuit 540 is communicating and the second transmit node 525 is disconnected, the system 500 reverts to 1×2 MIMO mode, thus impacting only uplink data throughput because only one transmitter is allowed to operate. Obviously, a decision to limit only the downlink data throughput, implemented by swapping the connections of receiver 520 and transmitter 525, may be preferable in specific applications, for instance real-time video upstream. When the land-mobile-radio circuit 540 is not transmitting, the 2×2 MIMO mode allows up to twice the upstream (or downstream in the aforementioned alternative embodiment) data throughput compared to the 1×2 MIMO mode.

Figure 14:
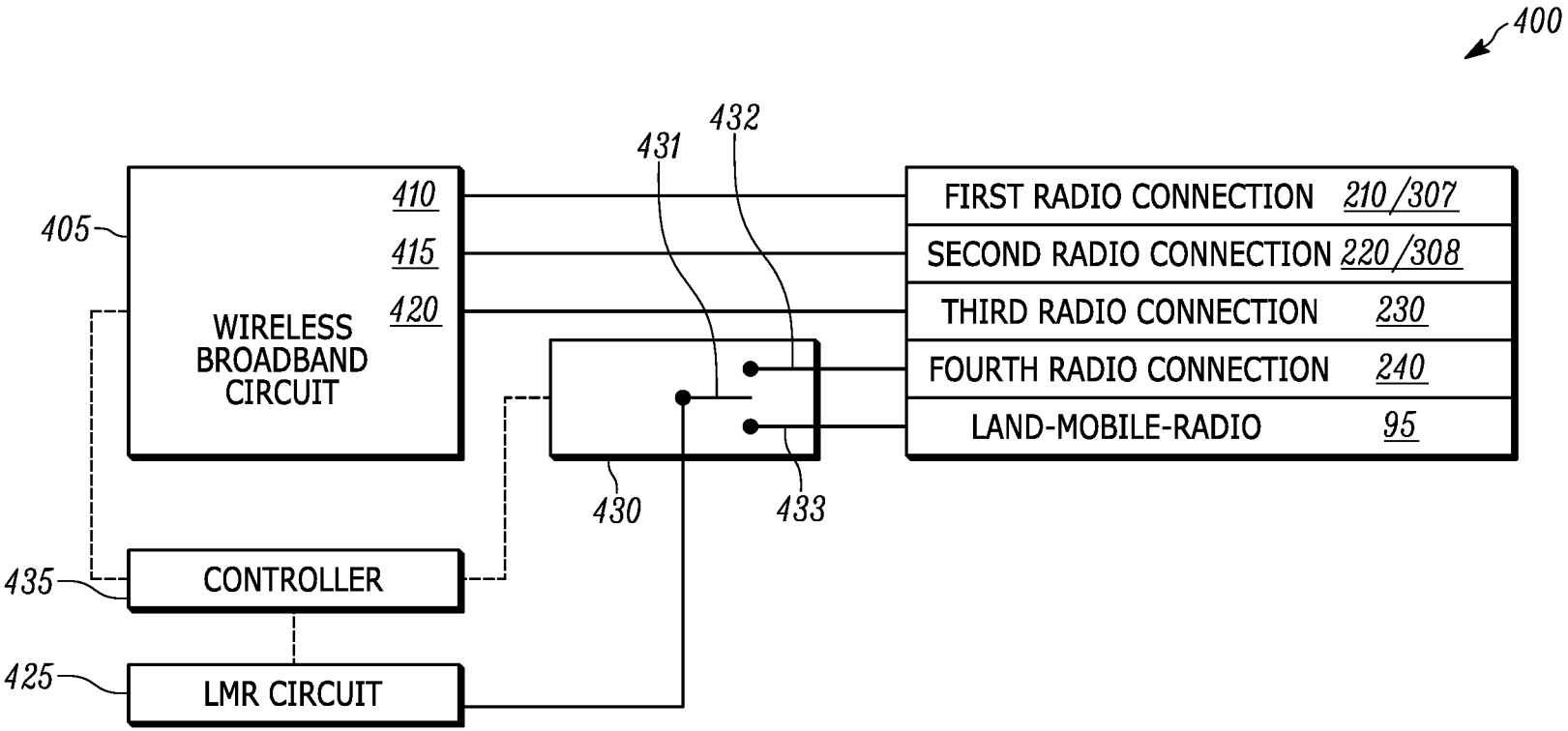
FIG. 14 is a block diagram of a Wireless broadband/Land-Mobile-Radio system capable of a 1×2 multiple-input/multiple-output (MIMO) communication using the antenna systems of FIG. 2 or 8.

It is also possible to employ a switch matrix in lieu of single-pole-double-throw switch 530 in order to realize land-mobile-radio pattern diversity, as done in FIG. 14. In this case, the switch matrix, which is capable of interconnecting any two pairs of its ports, is interconnected with second transmit node 525, radio connection 240, land-mobile-radio circuit 540, and the central land-mobile-radio antenna. Whenever the Land-Mobile-Radio transmitter is engaged, node 525 is disconnected and the land-mobile-radio circuit 540 is connected with radio connection 240 to realize an uptilt pattern while the land-mobile-radio antenna is connected to a suitable passive load to effect suitable electromagnetic coupling to the peripheral antennas fed from radio connection 240, or, alternatively, land-mobile-radio circuit 540 is connected with the central land-mobile-radio antenna to realize an horizon-focused pattern while radio-frequency port 240 is connected to a suitable passive load to effect suitable electromagnetic coupling of the peripheral antennas to the land-mobile-radio antenna.

Figure 16:
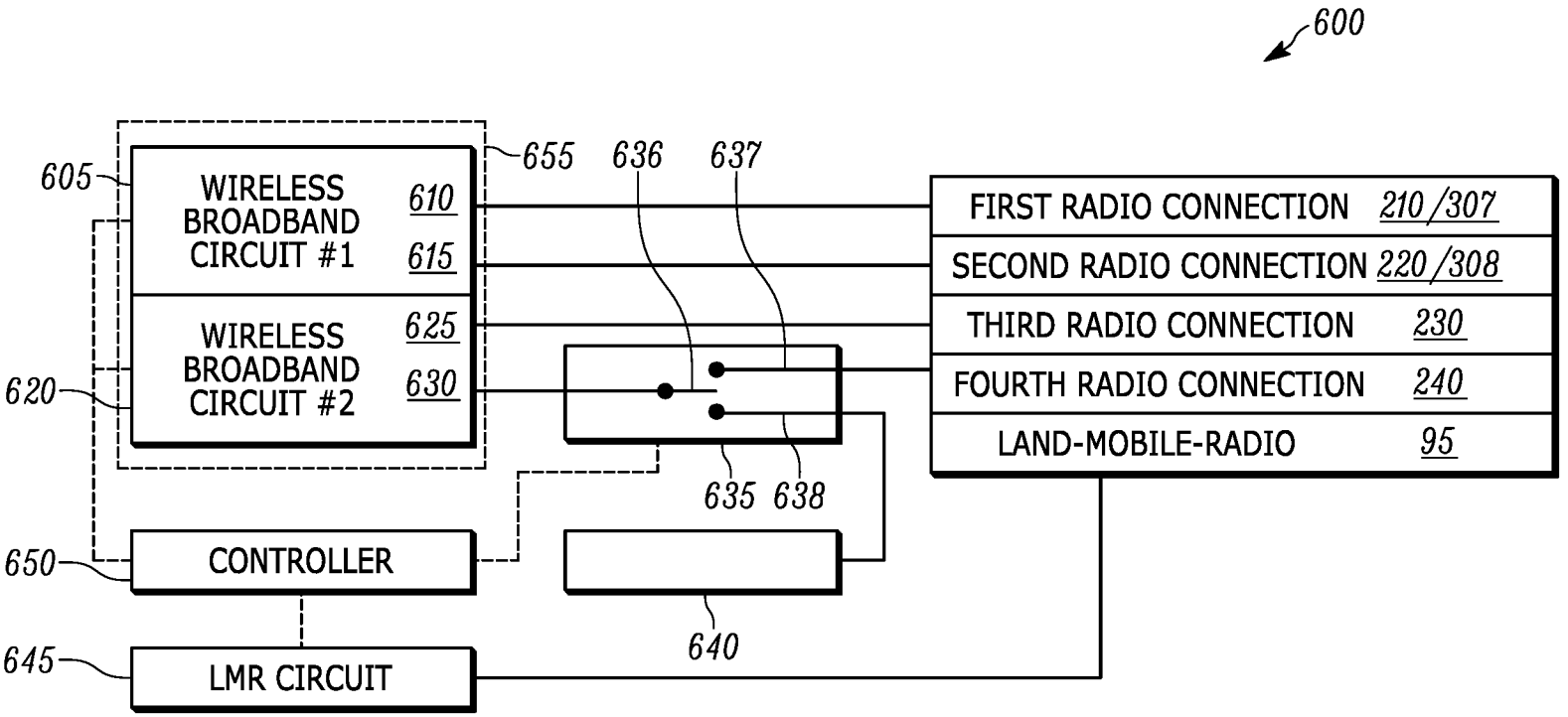
FIG. 16 is a block diagram of a Wireless broadband/Land-Mobile-Radio system capable of a dual wireless broadband communication using the antenna systems of FIG. 2 or 8.

FIG. 16 is a block diagram of a wireless broadband/Land-Mobile-Radio system 600 capable of dual wireless broadband call communication using the antenna systems 100 and 300. A first wireless broadband-circuit 605 has a first duplexed transmit/receive node 610 coupled to the first radio connection 210/307, and a first secondary receive node 615 coupled to the second radio connection 220/308. A second wireless broadband circuit 620, which may operate in a separate network, has a second duplexed transmit/receive node 625 coupled to the third radio connection 230, and a second secondary receive node 630 coupled to a switch 635 (for example, a single-pole-double-throw relay having a pole 636, a first throw 637, and a second throw 638) which is also coupled to the fourth radio connection 240 and a passive load 640. Alternatively, first secondary receive node 615 may be coupled to the third radio connection 230, which in antenna system 100 presents a markedly different radiation pattern compared to the pattern of radio connection 210/307 thus improving MIMO receive performance, while second duplexed transmit/receive node 625 is then coupled to the second radio connection 220/308. Obviously, other combinations of transmit and receive nodes 610, 615, 625, 630 interconnections with radio connections 210, 220, 230, 240 may be preferable in specific applications.

A land-mobile-radio circuit 645 is coupled to the central land-mobile-radio antenna. A controller 650 controls operation of the wireless broadband and land-mobile-radio circuits 605 and 645 and the switch 635.

In the wireless broadband/Land-Mobile-Radio system 600, when the land-mobile-radio circuit 645 is communicating, the switch 635 couples the fourth radio connection 240 to the passive load 640 (reducing the coupling effects between the fourth radio connection 240 and the land-mobile-radio antenna) and disconnects the second secondary receive node 630. The first wireless broadband circuit 605 and the second wireless broadband circuit 620 may reside on a single chip 655, and the first wireless broadband circuit 605 and the second wireless broadband circuit 620 may operate on the same or independent networks. In addition, the first wireless broadband circuit 605 and the second wireless broadband circuit 620 may be used to provide redundancy, for instance, by up-streaming the same real-time video stream through the uplinks of independent cellular networks.

Similarly to the communication system in FIG. 15, also in this case it is possible to employ a switch matrix in lieu of single-pole-double-throw switch 635 in order to realize land-mobile-radio pattern diversity as done in FIG. 14. In this case, the switch matrix, which is capable of interconnecting any two pairs of its ports, is interconnected with second secondary receive node 630, radio connection 240, land-mobile-radio circuit 645, and the central land-mobile-radio antenna. Whenever the land-mobile-radio transmitter is engaged, node 630 is disconnected and the land-mobile-radio circuit 645 is connected with radio connection 240 to realize an uptilt pattern while the land-mobile-radio antenna is connected to a suitable passive load to effect suitable electromagnetic coupling to the peripheral antennas fed from radio connection 240, or, alternatively, land-mobile-radio circuit 645 is connected with the central land-mobile-radio antenna to realize an horizon-focused pattern while radio connection 240 is connected to a suitable passive load to effect suitable electromagnetic coupling of the peripheral antennas to the land-mobile-radio antenna.

The embodiments above may provide a compact vehicle-mount antenna system with excellent wireless broadband and land-mobile-radio performances due to negligible coupling and pattern correlation. High wireless broadband/land-mobile-radio transceiver isolation allows coexistence in a collocated arrangement, reduces the need for wireless broadband duplexers, and enables 2×2 MIMO or multiple wireless broadband calls simultaneously. Possible implementations of the antenna systems 100 and 300 include police, fire-fighters, emergency medical vehicles, or drones equipped with land-mobile-radio and wireless broadband transceivers.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a," "has . . . a," "includes . . . a," or "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially," "essentially," "approximately," "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (for example, comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. An antenna system comprising:

a central antenna;

a plurality of peripheral antennas positioned symmetrically around the central antenna;

a first coupler providing a first radio connection and a second radio connection;

a first 180 degree hybrid coupler coupled to a first two diametrically opposed antennas of the plurality of peripheral antennas;

a second 180 degree hybrid coupler coupled to a second two diametrically opposed antennas of the plurality of peripheral antennas;

a third 180 degree hybrid coupler coupled to the first and second 180 degree hybrid couplers, the third 180 degree hybrid coupler providing a third radio connection and a fourth radio connection;

wherein the first, second, third, and fourth radio connections are decoupled from each other, and the first, second, and third system radio connections are decoupled from the central antenna.

2. The antenna system of claim 1, wherein the first coupler is a 90 degree hybrid coupler coupled to the first 180 degree hybrid coupler and to the second 180 degree hybrid coupler, the 90 degree hybrid coupler providing the first and second radio connections.

3. The antenna system of claim 2, wherein the 90 degree hybrid coupler is coupled to difference nodes of the first and second 180 degree hybrid couplers.

4. The antenna system of claim 1, wherein the first coupler is a fourth 180 degree hybrid coupler coupled to the first 180 degree hybrid coupler and to the second 180 degree hybrid coupler, the fourth 180 degree hybrid coupler providing the first and second radio connections.

5. The antenna system of claim 4, wherein the fourth 180 degree hybrid coupler is coupled to difference nodes of the first and second 180 degree hybrid couplers.

6. The antenna system of claim 1, wherein the first two diametrically opposed antennas are orthogonally positioned from the second two diametrically opposed antennas.

7. The antenna system of claim 1, wherein the third 180 degree hybrid coupler is coupled to summing nodes of the first and second 180 degree hybrid couplers.

8. A wireless broadband/Land-Mobile-Radio system comprising an antenna system having a central antenna;

a plurality of peripheral antennas positioned symmetrically around the central antenna;

a first coupler providing a first radio connection and a second radio connection;

a first 180 degree hybrid coupler coupled to a first two diametrically opposed antennas of the plurality of peripheral antennas;

a second 180 degree hybrid coupler coupled to a second two diametrically opposed antennas of the plurality of peripheral antennas;

a third 180 degree hybrid coupler coupled to the first and second 180 degree hybrid couplers, the third 180 degree hybrid coupler providing a third radio connection and a fourth radio connection;

a wireless broadband circuit having a transmit node coupled to the first radio connection, a receive node coupled to the second radio connection, and a secondary receive node coupled to the third radio connection;

a Land-Mobile-Radio circuit;

a controller;

a single-pole-double-throw relay having a pole, a first throw, and a second throw, the pole coupled to the Land-Mobile-Radio circuit, the first throw coupled to the fourth radio connection and the second throw coupled to the central antenna;

wherein the first, second, third, and fourth radio connections are decoupled from each other, and the first, second, and third system radio connections are decoupled from the central antenna.

9. The wireless broadband/Land-Mobile-Radio system of claim 8, wherein the controller couples the Land-Mobile-Radio circuit to the fourth radio connection for greater up-tilt communication and couples the Land-Mobile-Radio circuit to the central antenna for greater horizontal communication.

10. A wireless broadband/Land-Mobile-Radio system comprising an antenna system having a central antenna;

a plurality of peripheral antennas positioned symmetrically around the central antenna;

a first coupler providing a first radio connection and a second radio connection;

a first 180 degree hybrid coupler coupled to a first two diametrically opposed antennas of the plurality of peripheral antennas;

a second 180 degree hybrid coupler coupled to a second two diametrically opposed antennas of the plurality of peripheral antennas;

a third 180 degree hybrid coupler coupled to the first and second 180 degree hybrid couplers, the third 180 degree hybrid coupler providing a third radio connection and a fourth radio connection;

a single-pole-double-throw relay having a pole, a first throw, and a second throw, the pole coupled to the fourth radio connection and the first throw coupled to a passive load;

a wireless broadband circuit having a first transmit node coupled to the first radio connection, a first receive node coupled to the second radio connection, a second receive node coupled to the third radio connection, and a second transmit node coupled to the second throw of the single-pole-double-throw relay;

a Land-Mobile-Radio circuit coupled to a central antenna; and a controller;

wherein the first, second, third, and fourth radio connections are decoupled from each other, and the first, second, and third system radio connections are decoupled from the central antenna.

11. The wireless broadband/Land-Mobile-Radio system of claim 10, wherein, when the Land-Mobile-Radio circuit is communicating, the controller disconnects the second transmit node and couples the fourth radio connection to the passive load.

12. The wireless broadband/Land-Mobile-Radio system of claim 10, wherein, when the Land-Mobile-Radio circuit is not communicating, the controller couples the second transmit node to the fourth radio connection.

13. A wireless broadband/Land-Mobile-Radio system comprising an antenna system as claimed in claim 1;

a single-pole-double-throw relay having a pole, a first throw, and a second throw, the pole coupled to the fourth radio connection and the first throw coupled to a passive load;

a wireless broadband circuit having a first duplexed transmit/receive node coupled to the first radio connection, a first secondary receive node coupled to the second radio connection, a second duplexed transmit/receive node coupled to the third radio connection, and a second secondary receive node coupled to the second throw of the single-pole-double-throw relay;

a Land-Mobile-Radio circuit coupled to a fifth antenna; and a controller.

14. The wireless broadband/Land-Mobile-Radio system of claim 13, wherein, when the Land-Mobile-Radio circuit is communicating, the controller disconnects the second secondary receive node and couples the fourth radio connection to the passive load.

15. The wireless broadband/Land-Mobile-Radio system of claim 13, wherein, when the Land-Mobile-Radio circuit is not communicating, the controller couples the second secondary receive node to the fourth radio connection.

16. A wireless broadband/Land-Mobile-Radio system comprising an antenna system having a central antenna;

a plurality of peripheral antennas positioned symmetrically around the central antenna;

a first coupler providing a first radio connection and a second radio connection;

a first 180 degree hybrid coupler coupled to a first two diametrically opposed antennas of the plurality of peripheral antennas;

a second 180 degree hybrid coupler coupled to a second two diametrically opposed antennas of the plurality of peripheral antennas;

a third 180 degree hybrid coupler coupled to the first and second 180 degree hybrid couplers, the third 180 degree hybrid coupler providing a third radio connection and a fourth radio connection;

a switch matrix;

a wireless broadband circuit having a first node coupled to the first radio connection, a second node coupled to the second radio connection, a third node coupled to the third radio connection, and a fourth node coupled to a first node of the switch matrix;

a Land-Mobile-Radio circuit coupled to a second node of the switch matrix; and the fourth radio connection coupled to a third node of the switch matrix; and a central antenna coupled to a fourth node of the switch matrix; and a passive load coupled to a fifth node of the switch matrix; and a controller;

wherein the first, second, third, and fourth radio connections are decoupled from each other, and the first, second, and third system radio connections are decoupled from the central antenna.

17. The wireless broadband/Land-Mobile-Radio system of claim 16, wherein, when the Land-Mobile-Radio circuit is communicating, the controller disconnects the second secondary receive node and couples the fourth radio connection to the passive load, and the Land-Mobile-Radio circuit to the central antenna for greater horizontal communication.

18. The wireless broadband/Land-Mobile-Radio system of claim 16, wherein, when the Land-Mobile-Radio circuit is communicating, the controller disconnects the second secondary receive node and couples the central antenna to the passive load, and the Land-Mobile-Radio circuit to the fourth radio connection for greater upwards communication.

* * * * *